US010760376B2

(12) United States Patent
Loh et al.

(10) Patent No.: US 10,760,376 B2
(45) Date of Patent: Sep. 1, 2020

(54) PRESSURE CONTROL VALVE FOR DOWNHOLE TREATMENT OPERATIONS

(71) Applicants: Yuh Loh, Cypress, TX (US); Fahmi Bahrini, Aubervilliers (FR); Gerald Whitley, Jr., Houston, TX (US)

(72) Inventors: Yuh Loh, Cypress, TX (US); Fahmi Bahrini, Aubervilliers (FR); Gerald Whitley, Jr., Houston, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 466 days.

(21) Appl. No.: 15/449,031

(22) Filed: Mar. 3, 2017

(65) Prior Publication Data

US 2018/0252072 A1 Sep. 6, 2018

(51) Int. Cl.

| | |
|---|---|
| ***E21B 34/10*** | (2006.01) |
| ***E21B 34/06*** | (2006.01) |
| ***E21B 34/14*** | (2006.01) |

(52) U.S. Cl.
CPC ..... *E21B 34/10* (2013.01); *E21B 34/06* (2013.01); *E21B 34/14* (2013.01)

(58) Field of Classification Search
CPC ..... E21B 34/10; E21B 34/06; E21B 34/14
See application file for complete search history.

(56) References Cited

U.S. PATENT DOCUMENTS

| | | | | |
|---|---|---|---|---|
| 2,634,689 | A | 4/1953 | Walton | |
| 5,332,042 | A * | 7/1994 | Walter | E21B 34/06 137/516.25 |
| 5,445,224 | A * | 8/1995 | Comeaux | E21B 34/10 137/102 |
| 6,474,421 | B1 | 11/2002 | Stoesz | |
| 7,191,830 | B2 | 3/2007 | McVay | |
| 7,614,452 | B2 | 11/2009 | Kenison | |
| 8,561,703 | B2 | 10/2013 | Mahmoud et al. | |
| 8,763,706 | B2 | 7/2014 | Lembcke | |
| 9,376,896 | B2 | 6/2016 | Smith et al. | |
| 9,447,658 | B2 | 9/2016 | He et al. | |
| 2008/0066921 | A1 | 3/2008 | Bane et al. | |

(Continued)

FOREIGN PATENT DOCUMENTS

WO 2016093706 A1 6/2016

OTHER PUBLICATIONS

He et al., Development and qualification of a high-pressure, high-temperature chemical injection valve, Offshore Technology Conference Asia, OTC ASIA 2014: Meeting the Challenges for Asia's Growth, May 2014.

(Continued)

*Primary Examiner* — Yong-Suk Ro
(74) *Attorney, Agent, or Firm* — Cantor Colburn LLP

(57) ABSTRACT

A pressure control valve for downhole treatment operations includes a valve body including an inlet, an outlet, and a valve seat. A valve assembly is arranged in the valve body. The valve assembly includes a valve member selectively positionable on the valve seat to control fluid flow through the valve body. A piston assembly including a piston and a control fluid inlet is arranged in the valve body. The piston is operatively connected to the valve assembly. The piston is operable to bias the valve member toward a closed configuration upon exposure to a control fluid.

20 Claims, 9 Drawing Sheets

(56) References Cited

U.S. PATENT DOCUMENTS

| | | | | |
|---|---|---|---|---|
| 2009/0008102 | A1* | 1/2009 | Anderson | E21B 34/10 166/373 |
| 2009/0188662 | A1 | 7/2009 | Casciaro et al. | |
| 2011/0067879 | A1 | 3/2011 | Kleppa et al. | |
| 2014/0332227 | A1 | 11/2014 | Randazzo | |
| 2015/0151421 | A1 | 6/2015 | Jones et al. | |
| 2015/0233220 | A1 | 8/2015 | Tiong | |
| 2015/0330183 | A1* | 11/2015 | Sevheim | E21B 34/10 166/375 |

OTHER PUBLICATIONS

Notification of Transmittal of the International Search Report; PCT US/2018/016405; dated May 28, 2018; 4 pages.
Written Opinion of the International Searching Authority; PCT US/2018/016405; dated May 28, 2018; 11pages.

* cited by examiner

PRESSURE CONTROL VALVE FOR DOWNHOLE TREATMENT OPERATIONS

BACKGROUND

Downhole systems rely on various valves to control fluid flow. On occasion, it is desirable to introduce a fluid, such as a chemical into a wellbore or other portion of a downhole system. Chemical injection systems typically rely on a normally closed chemical injection valve (CIV). The CIV includes a dart that is biased against a seat through a spring. A preload is applied to the spring prior to introducing the CIV downhole. A liquid is introduced into the CIV at a pressure sufficient to move the dart off the seat against the pressure applied by the spring. Once unseated, the liquid may then flow through the valve.

Once introduced downhole, the preload on the spring cannot be adjusted without withdrawing the CIV from the wellbore. Without modification of the preload, adjustments to liquid pressure are limited. That is, the liquid being introduced into the CIV must be at least at a pressure sufficient to unseat the dart. Withdrawing the CIV is a time consuming and costly process. Adjusting the preload is also a time consuming process requiring cutting the CIV open and then welding it closed. In most cases, if there are issues with the preload, the CIV is simply discarded. Accordingly, once a preload is chosen, operators are limited to a particular pressure floor for the liquid.

SUMMARY

A pressure control valve for downhole treatment operations includes a valve body including an inlet, an outlet, and a valve seat. A valve assembly is arranged in the valve body. The valve assembly includes a valve member selectively positionable on the valve seat to control fluid flow through the valve body. A piston assembly including a piston and a control fluid inlet is arranged in the valve body. The piston is operatively connected to the valve assembly. The piston is operable to bias the valve member toward a closed configuration upon exposure to a control fluid.

A resource exploration and recovery system includes a surface system including a fluid storage zone, and a downhole system including a plurality of tubulars and a pressure control valve. The pressure control valve includes a valve body including an inlet fluidically connected to the fluid storage zone, an outlet, and a valve seat. A valve assembly is arranged in the valve body. The valve assembly includes a valve member selectively positionable on the valve seat to control fluid flow through the valve body. A piston assembly including a piston and a control fluid inlet is arranged in the valve body. The piston is operatively connected to the valve assembly.

BRIEF DESCRIPTION OF THE DRAWINGS

Referring now to the drawings wherein like elements are numbered alike in the several Figures.

DETAILED DESCRIPTION

Figure 1:
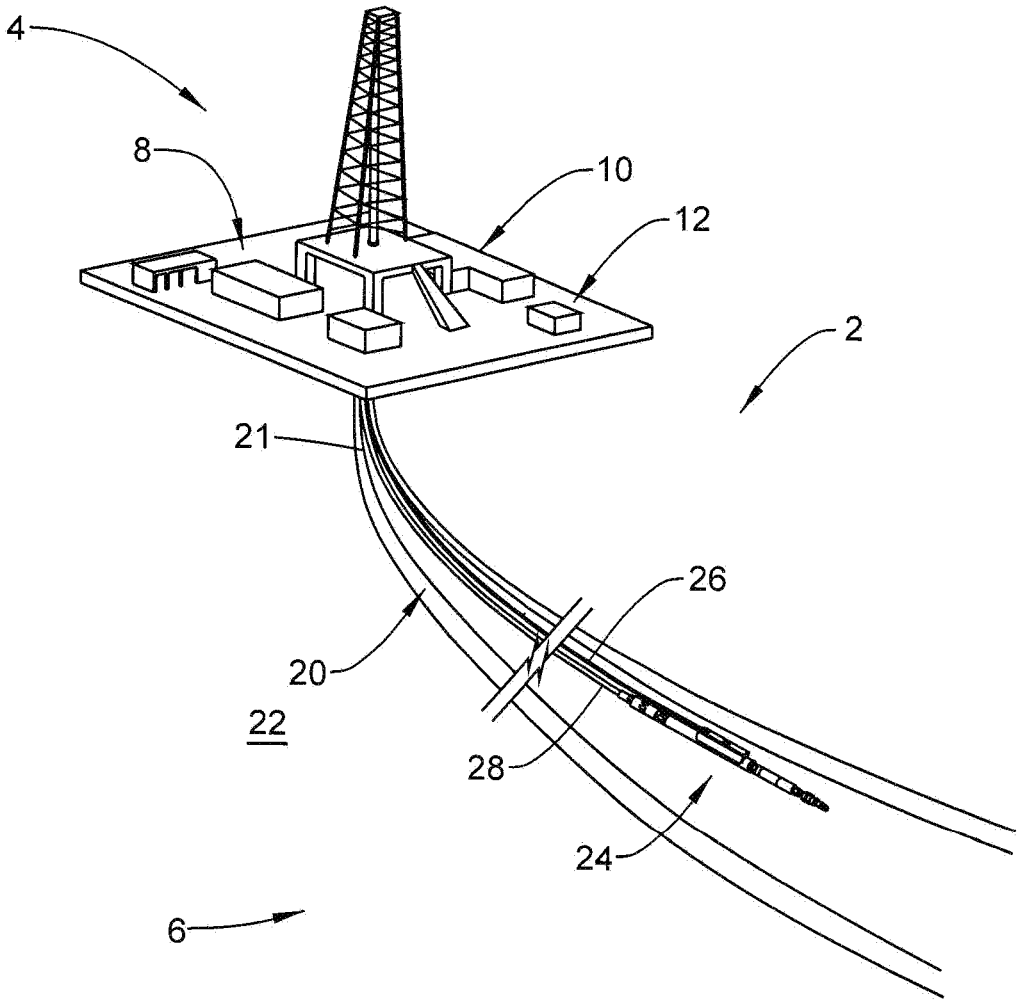
FIG. 1 depicts a resource exploration and recovery system including a pressure control valve, in accordance with an exemplary embodiment.
Figure 2:
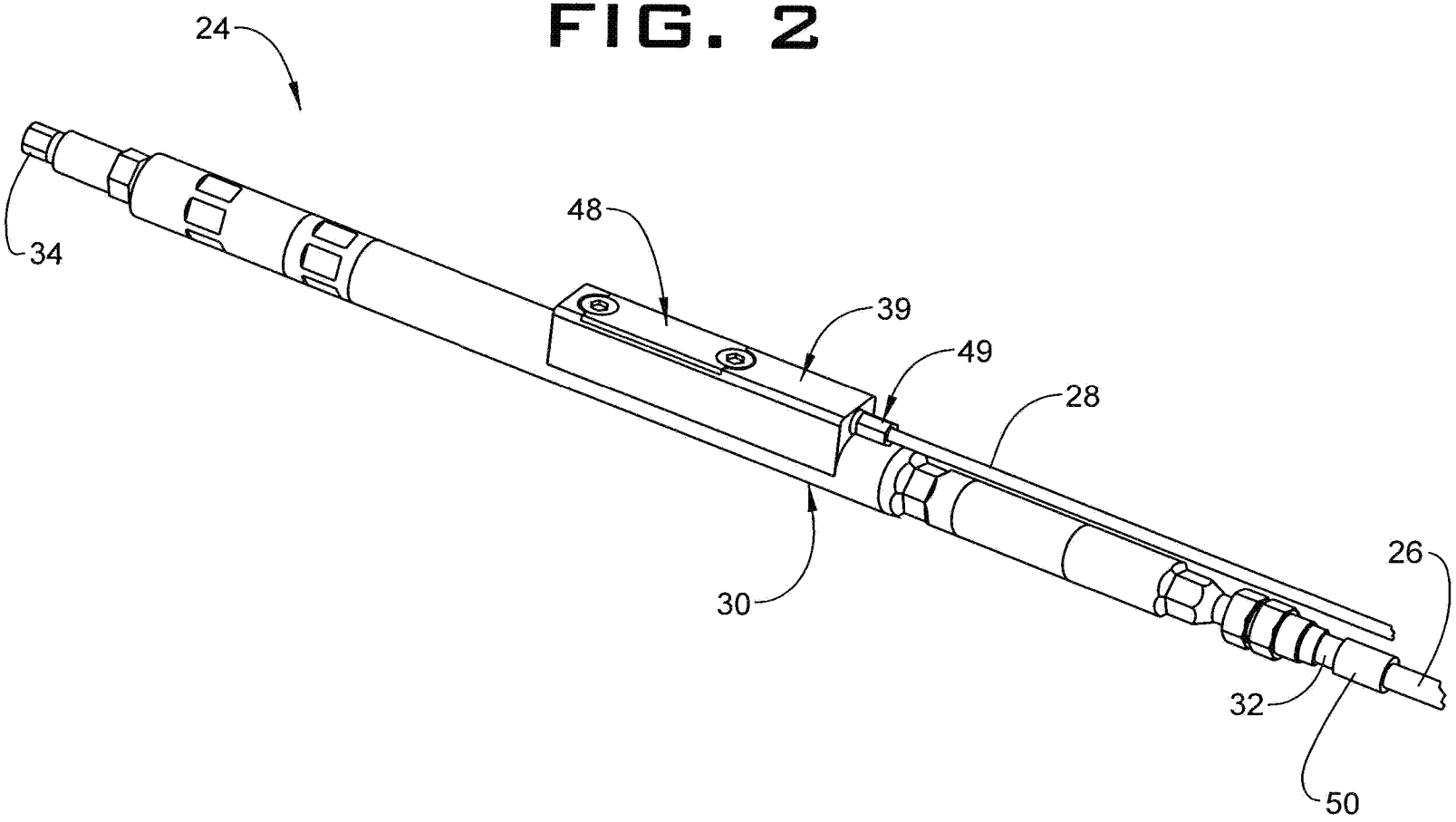
FIG. 2 depicts a plan view of the pressure control valve, in accordance with an aspect of an exemplary embodiment.

A resource exploration system, in accordance with an exemplary embodiment, is indicated generally at 2, in FIG. 1. Resource exploration system 2 should be understood to include well drilling operations, resource extraction and recovery, $CO_2$ sequestration, and the like. Resource exploration system 2 may include a surface system 4 operatively connected to a downhole system 6. Surface system 4 may include pumps 8 that may aid in treatment, completion and/or extraction processes, as well as a fluid storage zone 10. Fluid storage zone 10 may contain a gravel pack fluid or slurry (not shown), a fracturing fluid (also not shown), or a treating fluid that may be introduced into downhole system 6. Surface system 4 may also include a control fluid source 12.

Downhole system 6 may include a system of tubulars 20 that is extended into a wellbore 21 formed in formation 22. One of tubulars 20 may support a pressure control valve 24 that may be employed to inject a fluid treatment into formation 22. Pressure control valve 24 may be fluidically connected to fluid storage zone 10 through a first conduit 26. Pressure control valve 24 may also be connected to control fluid source 12 through a second fluid conduit 28. As shown in FIGS. 2-5, pressure control valve 24 includes a valve body 30 having an inlet 32 that may be fluidically connected to fluid storage zone 10 through first conduit 26 and an outlet 34. Pressure control valve 24 includes a valve assembly 37 (FIG. 3) arranged in a valve housing 39. A piston assembly 41 is also arranged in valve housing 39 and operatively connected to valve assembly 37.

Piston assembly 41 includes a piston 43 linked to a holder 45 that is selectively moveable along a support 46. Piston assembly 41 includes a control fluid inlet 47 that may be fluidically connected to control fluid source 12. Valve housing 39 may include an access cover 48 that provides access to valve assembly 37 and piston assembly 41. A first fluid supply line connector 49 may be arranged at control fluid inlet 47. First fluid supply line connector 49 connects to second fluid conduit 28 for delivering a control fluid to piston assembly 41. A second fluid supply line connector 50 may be arranged at inlet 32. Second fluid supply line connector 50 connects first conduit 26 to valve assembly 37 for delivering fluid, such as a treatment fluid, from fluid storage zone 10 through valve assembly 37.

In accordance with an aspect of an exemplary embodiment, valve assembly 37 includes a setting tube 53 (FIG. 3) operatively connected to piston 43 through holder 45. Setting tube 53 includes a first end 56, a second end 57, and an intermediate portion 58. Setting tube 53 is slideably arranged in a valve passage 60 defined by a wall 62. Setting tube 53 is shown to include a flange 64 arranged at first end 56 and a recess 66 that is positioned on intermediate portion 58. Recess 66 is receptive to holder 45. Setting tube 53 also includes a passage 68 that extends through intermediate portion 58.

In accordance with an aspect of an exemplary embodiment, valve assembly 37 includes a valve member 74 including a valve stem 78 and a valve 80. Valve stem 78 that extends into passage 68 of setting tube 53. Valve 80 interacts with a valve seat 83 (FIG. 5) to selectively control fluid flow through valve assembly 37. Valve 80 includes passage 84 and a number of sealing lands, two of which are indicated at 85 and 86 that interact with valve seat 83. That is, over time, valve 80 may deform as a result of exposure to operating pressures. If valve 80 deforms, and valve seat 83 begins to fail, valve 80 may move deeper into valve seat 83 such that valve seat 83 may begin to seat thereby prolonging an overall operational life of valve assembly 37.

Figure 5:
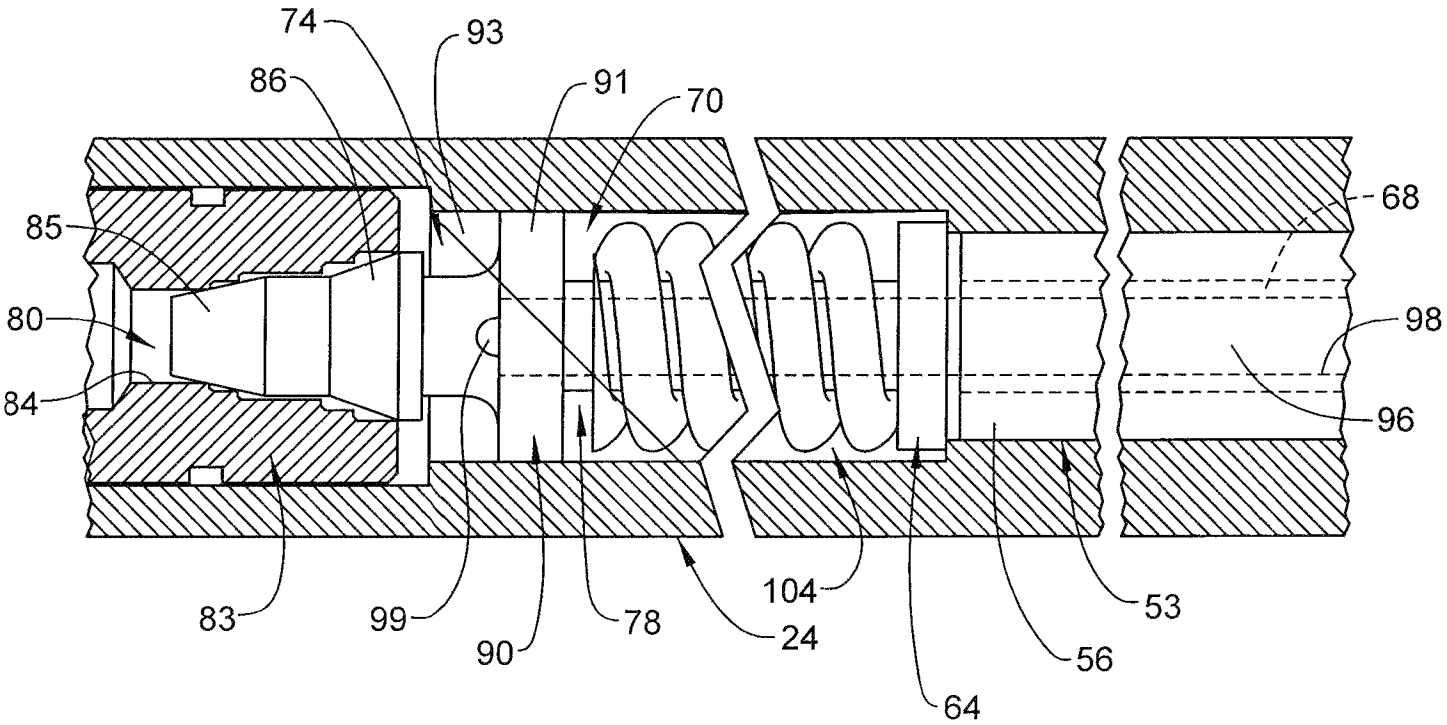
FIG. 5 depicts a valve seat of the pressure control valve of FIG. 3.
Figure 6:
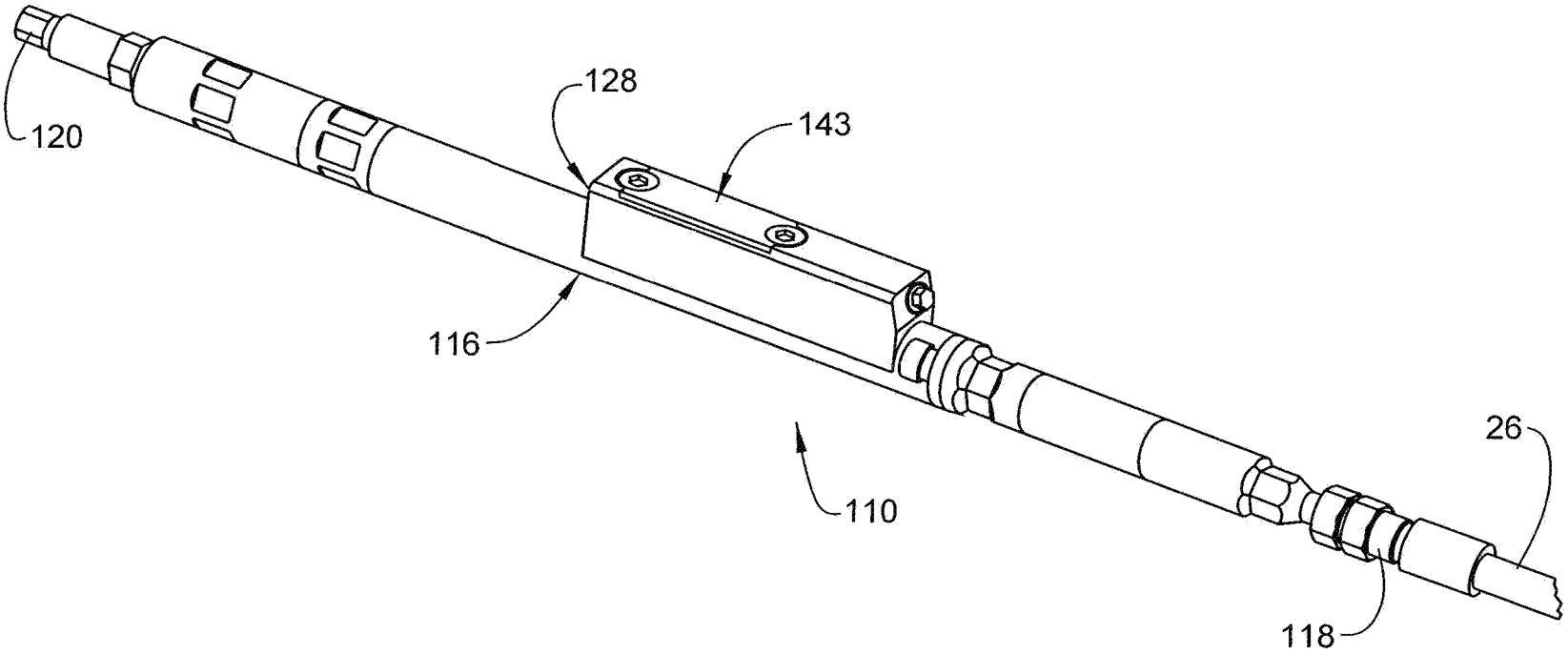
FIG. 6 depicts a plan view of a pressure control valve, in accordance with another aspect of an exemplary embodiment.

Valve member 74 also includes a flange 90 having an outer surface 91 that arranged adjacent to wall 62 of valve passage 60. In accordance with an aspect of an exemplary embodiment, a pressure chamber 93 may exist between flange 64 of setting tube 53 and flange 90 of valve member 70. In accordance with an aspect of an exemplary embodiment, a passage 96 extends through valve stem 78 (FIG. 5). Passage 96 includes an inlet portion 98 and a fluid outlet portion 99. Inlet portion 98 may be fluidically connected to control fluid source 12. In further accordance with an exemplary aspect, a cushioning spring 104 may be arranged between flange 64 of setting tube 53 and flange 90 of valve member 70. Cushioning spring 104 attenuates any vibrations that may occur during operation of valve member 74.

Figure 3:
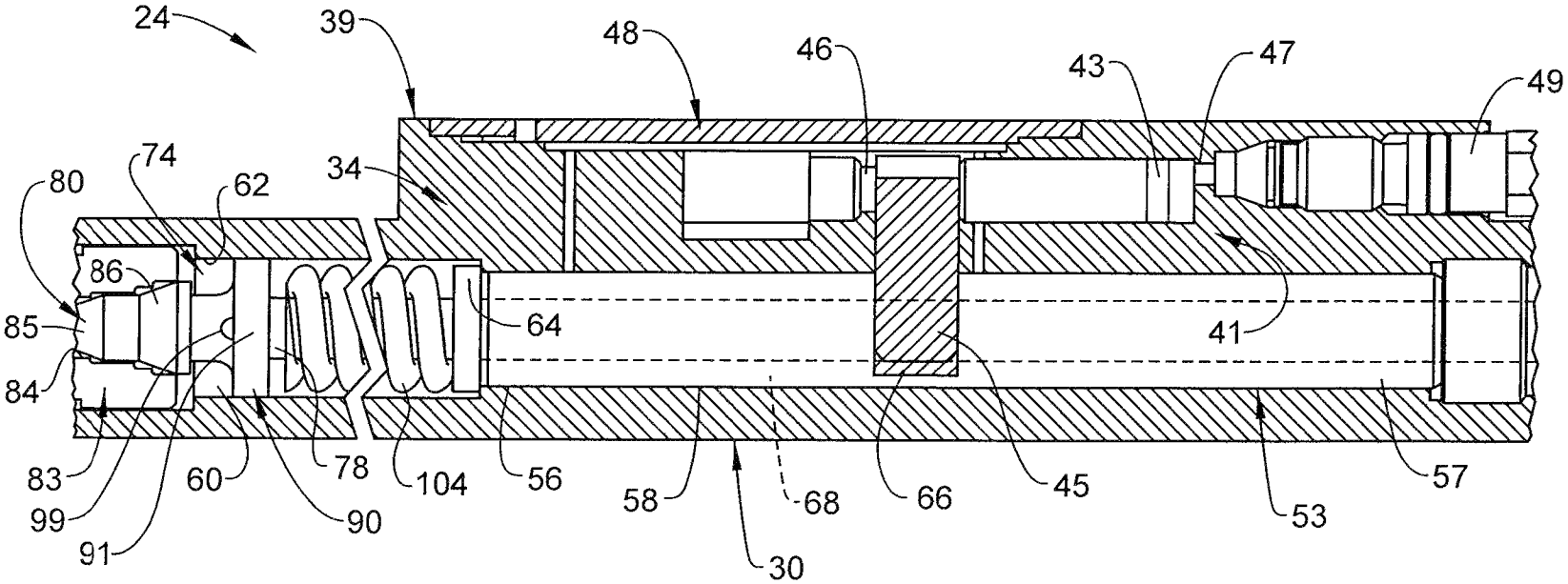
FIG. 3 depicts a cross-sectional view of the pressure control valve of FIG. 2 in a closed configuration.
Figure 4:
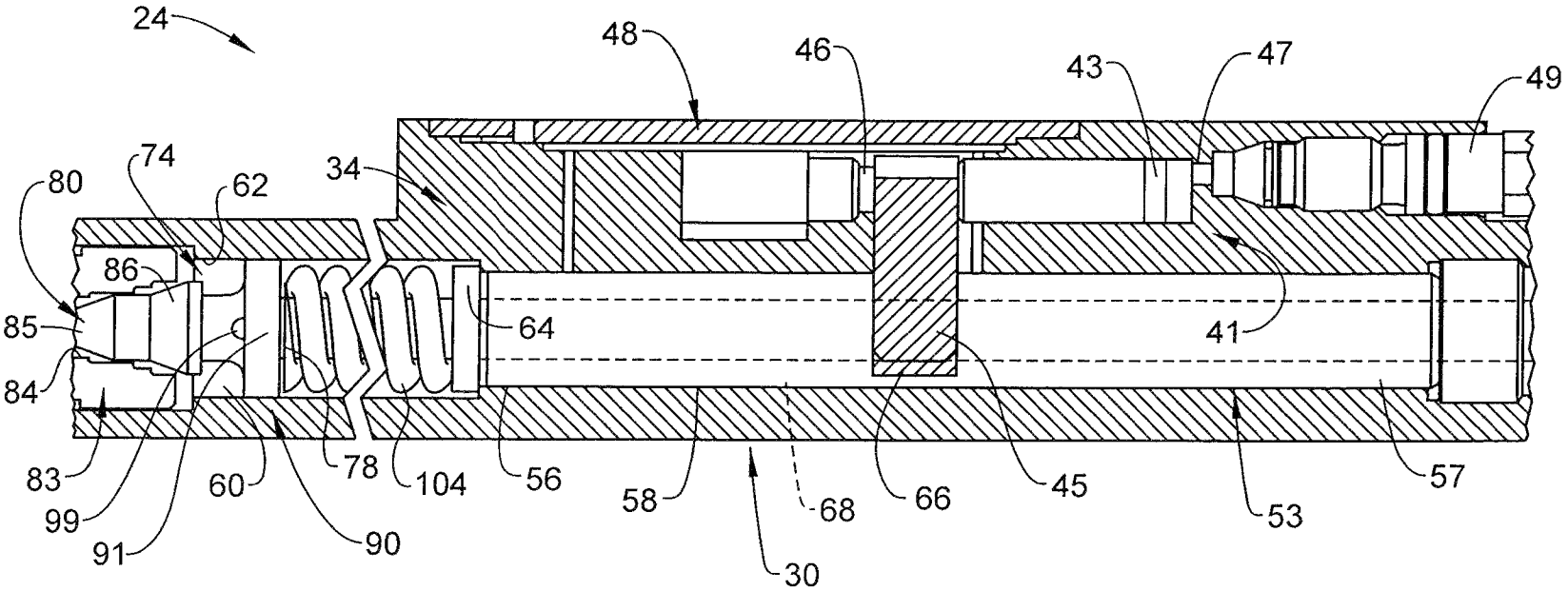
FIG. 4 depicts a cross-sectional view of the pressure control valve of FIG. 2 in an open configuration

In accordance with an aspect of an exemplary embodiment, pressurized control fluid is introduced into piston assembly 41. The control fluid pressure acts upon piston 43 moving setting tube 53 into valve passage 60. Flange 64 urges against cushioning spring 104 which, in turn, urges against flange 90 guiding valve 80 onto valve seat 83 as shown in FIG. 3. A treating fluid may be introduced into setting tube 53 through inlet 32. The treating fluid may pass through passage 96 in valve stem 78 and fluid into pressure chamber 93 through fluid outlet portion 99. The treating fluid may act upon flange 90 causing valve member 70 to shift against the pressure applied through piston assembly 41 unseating valve 80 from valve seat 83 (FIG. 4). At this point treating fluid may flow from inlet 32 through outlet 34 into, for example, formation 22.

In accordance with an aspect of an exemplary embodiment, if it is desired to change treating fluid pressure, pressure control valve 24 provides operators with more flexibility in varying fluid pressure of the treating fluid. That is, if it is desirable to lower treating fluid pressure, adjustments may be made to also lower the control fluid pressure. In this manner a lower treating fluid pressure may be used to operate pressure control valve 24 without the need to withdraw tubulars 20 string from wellbore 21 to make adjustments.

Reference will now follow to FIGS. 6-10 in describing a pressure control valve 110 in accordance with another aspect of an exemplary embodiment. Pressure control valve 110 includes a valve body 116 having a fluid inlet 118 that may be fluidically connected to fluid storage zone 10 through first conduit 26 and an outlet 120. A valve assembly 124 (FIG. 7) is arranged in a valve housing 128 of valve body 116. A piston assembly 131 is also arranged in valve housing 128 and is operatively connected to valve assembly 124. Piston assembly 131 includes a piston 134 operatively connected to a holder 136 that is shiftable along a support 138. Piston assembly 131 also includes a control fluid inlet 140. In a manner similar to that discussed above, valve body 116 includes an access cover 143 that provides access to valve assembly 124 and piston assembly 131.

Figure 7:
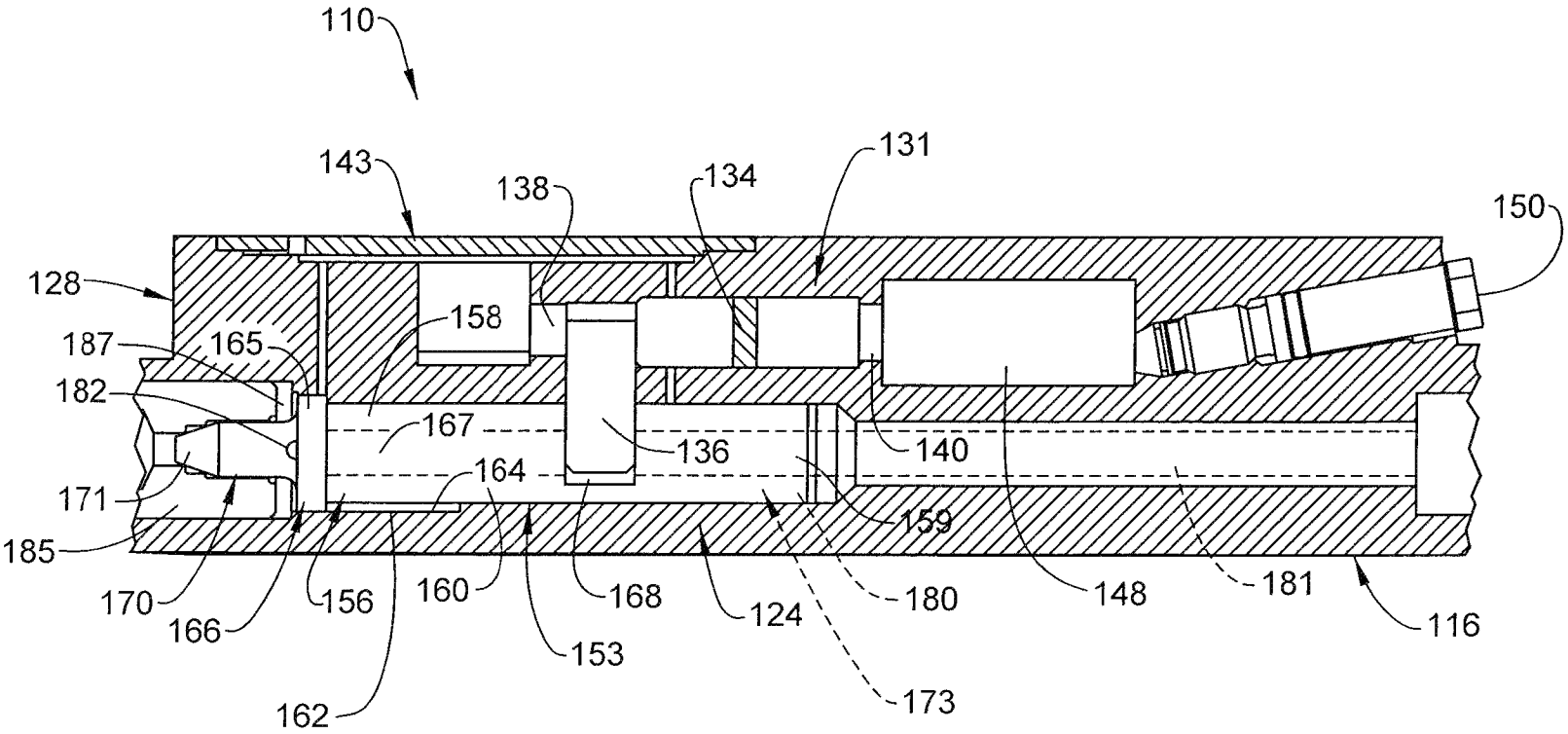
FIG. 7 depicts a cross-sectional view of the pressure control valve of FIG. 6 shown in a closed configuration.

In accordance with an aspect of an exemplary embodiment, valve body 116 includes a control fluid reservoir 148 that is fluidically connected to control fluid inlet 140. Control fluid reservoir 148 may contain an amount of pressurized control fluid that acts on piston 134 to bias pressure control valve 110 in a closed configuration such as shown in FIG. 7 as will be detailed more fully below. Control fluid may be introduced to control fluid reservoir 148 through a selectively removable plug 150 fitted in valve housing 128.

Figure 9:
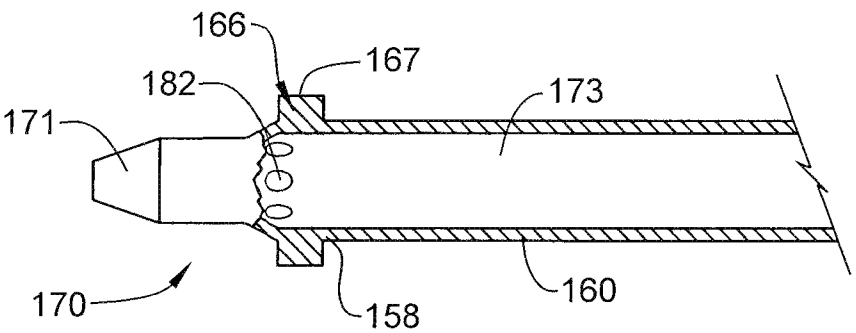
FIG. 9 depicts a cross-sectional view of a setting tube of the pressure control valve of FIG. 7.
Figure 10:
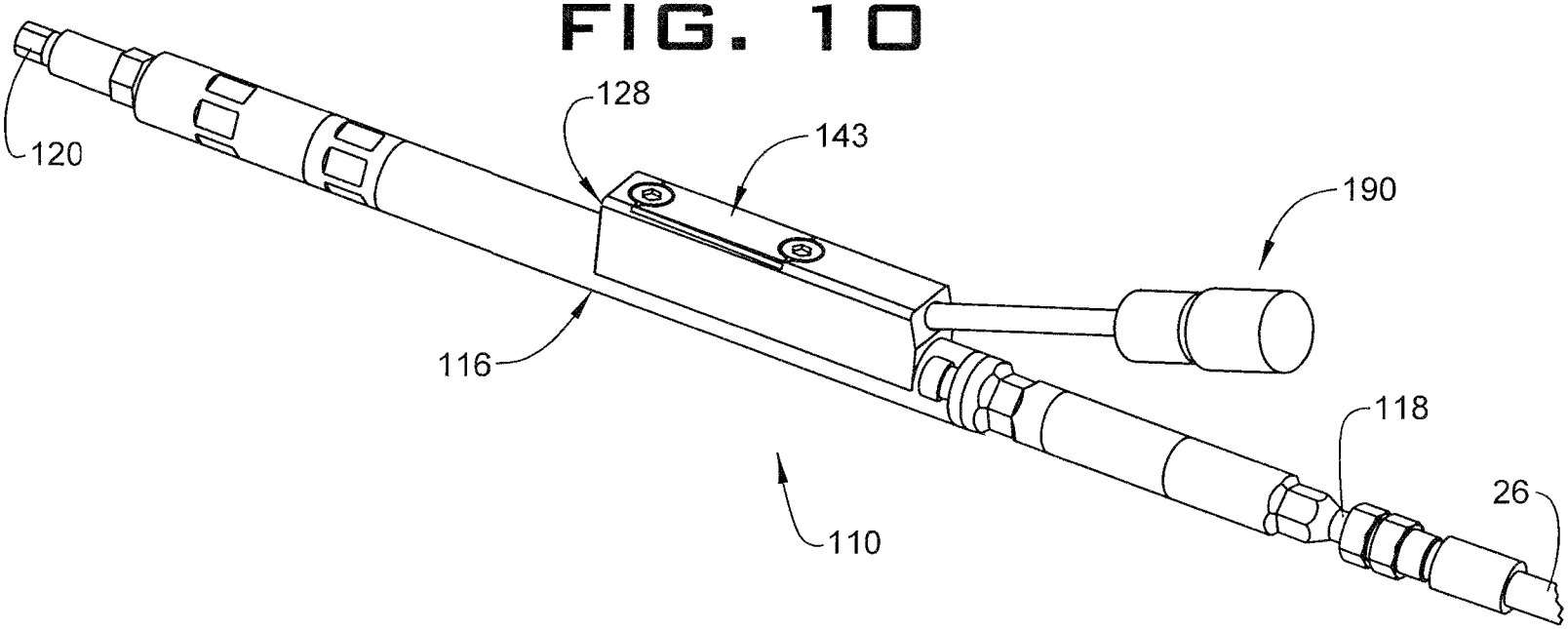
FIG. 10 depicts a valve fill adaptor for providing a change in control fluid in the pressure control valve of FIG. 7 while downhole, in accordance with an aspect of an exemplary embodiment.

In accordance with an aspect of an exemplary embodiment, valve assembly 124 includes a setting tube 156 including a first end 158, a second end 159, and an intermediate portion 160 (FIG. 9). Setting tube 156 is slideably arranged within a valve passage 162 defined by a wall 164. First end 158 of setting tube 156 includes a flange 166 having an outer surface 167 that may transition along wall 164. Setting tube 156 includes a recess 168 arranged along intermediate portion 160 that is receptive to holder 136. In this manner, movements of piston 134 are imparted to setting tube 156 through holder 136.

In accordance with an aspect of an exemplary embodiment, setting tube 156 includes a valve member 170 having a valve 171 extending axially outwardly from first end 158. A passage 173 extends through setting member 153 to valve member 170 (FIG. 9). Passage 173 includes an inlet portion 180 that may be fluidically connected with fluid inlet 118 through a valve conduit 181, and a fluid outlet portion 182 arranged at flange 166. Valve member 170 is selectively positionable on a valve seat 185 through movement of setting tube 156. A pressure chamber 187 may exist between valve seat 185 and flange 166.

Figure 8:
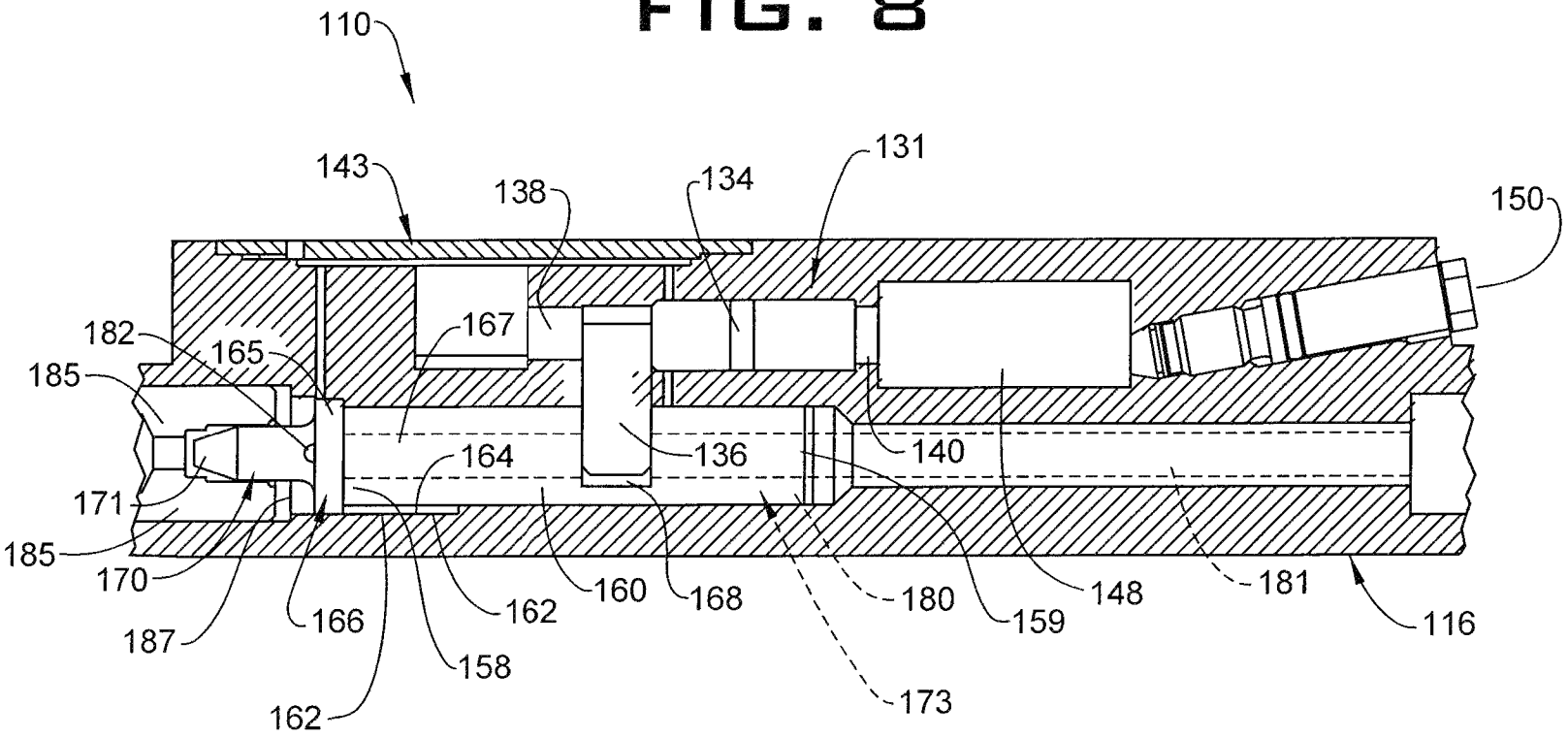
FIG. 8 depicts a cross-sectional view of the pressure control valve of FIG. 6 shown in an open configuration.

In accordance with an aspect of an exemplary embodiment, control fluid pressure is introduced into piston assembly 131. The control fluid pressure acts upon piston 134 moving setting tube 156 into valve passage 162 guiding valve 171 onto valve seat 185 as shown in FIG. 7. A treating fluid may be introduced into setting tube 156 through fluid inlet 118. The treating fluid may pass through passage 173 via valve conduit 181 into setting tube 156 via fluid inlet 118. The treating fluid may pass into pressure chamber 187 through fluid outlet portion 182. The treating fluid may act upon flange 166 causing valve member 170 to shift against the pressure applied through piston assembly 131 unseating valve 171 from valve seat 185 (FIG. 8). At this point treating fluid may flow from fluid inlet 118 through outlet 120 into, for example, formation 22.

In accordance with an aspect of an exemplary embodiment, if it is desired to change treating fluid pressure, pressure control valve 110 provides operators with more flexibility in varying fluid pressure of the treating fluid. That is, if it is desirable to lower treating fluid pressure, adjustments may be made to also lower the control fluid pressure in control fluid reservoir 148. For example, a tool (not shown) provided with a valve adaptor 190 (FIG. 10) may be introduced downhole. The tool may be manipulated to release an amount of control fluid from control fluid reservoir 148. In this manner a lower treating fluid pressure may be used to operate pressure control valve 110 without the need to withdraw tubulars 20 string from wellbore 21 to make adjustments. Additionally, if it is desirable to add additional control fluid or adjust control fluid pressure upwardly, the tool may be manipulated to add control fluid into control fluid reservoir 148 through valve adaptor 190. Thus valve adaptor 190 provides operators with an ability to service pressure control valve 110 while deployed downhole.

Embodiment 1

A pressure control valve for downhole treatment operations comprising: a valve body including an inlet, an outlet, and a valve seat; a valve assembly arranged in the valve body, the valve assembly including a valve member selectively positionable on the valve seat to control fluid flow through the valve body; and a piston assembly including a piston and a control fluid inlet arranged in the valve body, the piston being operatively connected to the valve assembly, the piston being operable to bias the valve member toward a closed configuration upon exposure to a control fluid.

Embodiment 2

The pressure control valve according to embodiment 1, wherein the valve assembly includes a setting tube arranged in the valve body and operatively coupled to the piston, the setting tube including a first end, a second end, and an intermediate portion defining a conduit.

Embodiment 3

The pressure control valve according to embodiment 2, wherein the valve member includes a valve stem extending into the conduit of the setting tube.

Embodiment 4

The pressure control valve according to embodiment 3, wherein valve member includes a first flange arranged on the valve stem.

Embodiment 5

The pressure control valve according to embodiment 4, wherein the setting tube includes a second flange arranged at the first end.

Embodiment 6

The pressure control valve according to embodiment 5, further comprising: a cushioning spring arranged between the first flange and the second flange.

Embodiment 7

The pressure control valve according to embodiment 4, wherein the valve stem includes passage fluidically connected to the inlet.

Embodiment 8

The pressure control valve according to embodiment 7, wherein the valve member includes a fluid outlet portion fluidically connected to the passage.

Embodiment 9

The pressure control valve according to embodiment 1, further comprising: a control fluid source fluidically connected to the control fluid inlet of the piston assembly, the control fluid source introducing a pressurized control fluid into the piston assembly shifting the piston to bias the valve member in the closed configuration.

Embodiment 10

The pressure control valve according to embodiment 9, wherein the control fluid source comprises a fluid reservoir arranged in the valve body and fluidically connected to the control fluid inlet.

Embodiment 11

A resource exploration and recovery system comprising: a surface system including a fluid storage zone; and a downhole system including a plurality of tubulars and a pressure control valve comprising: a valve body including an inlet fluidically connected to the fluid storage zone, an outlet, and a valve seat; a valve assembly arranged in the valve body, the valve assembly including a valve member selectively positionable on the valve seat to control fluid flow through the valve body; and a piston assembly including a piston and a control fluid inlet arranged in the valve body, the piston being operatively connected to the valve assembly.

Embodiment 12

The resource exploration and recovery system according to embodiment 11, wherein the valve assembly includes a setting tube arranged in the valve body and operatively coupled to the piston, the setting tube including a first end, a second end, and an intermediate portion defining a conduit.

Embodiment 13

The resource exploration and recovery system according to embodiment 12, wherein the valve member includes a valve stem extending into the conduit of the setting tube.

Embodiment 14

The resource exploration and recovery system according to embodiment 13, wherein valve member includes a first flange arranged on the valve stem.

Embodiment 15

The resource exploration and recovery system according to embodiment 14, wherein the setting tube includes a second flange arranged at the first end.

Embodiment 16

The resource exploration and recovery system according to embodiment 15, further comprising: a cushioning spring arranged between the first flange and the second flange.

Embodiment 17

The resource exploration and recovery system according to embodiment 14, wherein the valve stem includes passage fluidically connected to the inlet, the passage including a fluid outlet portion.

Embodiment 18

The resource exploration and recovery system according to embodiment 11, further comprising: a control fluid source fluidically connected to the control fluid inlet of the piston assembly, the control fluid source introducing a pressurized control fluid into the piston assembly shifting the piston to bias the valve member in the closed configuration.

Embodiment 19

The resource exploration and recovery system according to embodiment 18, wherein the control fluid source comprises a fluid reservoir arranged in the valve body and fluidically connected to the control fluid inlet.

Embodiment 20

The resource exploration and recovery system according to embodiment 18, wherein the valve body includes a fluid supply line connector fluidically connected to the control fluid inlet, the control fluid source being arranged at the surface system and fluidically connected to the valve body through a fluid supply line fluidically connected to the fluid supply line connector.

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While one or more embodiments have been shown and described, modifications and substitutions may be made thereto without departing from the spirit and scope of the invention. Accordingly, it is to be understood that the present invention has been described by way of illustrations and not limitation.

What is claimed is:

1. A pressure control valve for downhole treatment operations comprising:

a valve body including an inlet, an outlet, and a valve seat;

a valve assembly arranged in the valve body, the valve assembly including a valve member selectively positionable on the valve seat to control fluid flow through the valve body; and a piston assembly including a piston and a control fluid inlet arranged in the valve body, the piston being operatively connected to the valve assembly, the piston being operable to bias the valve member from an open configuration toward a closed configuration upon exposure to control fluid pressure from the control fluid inlet to initiate the downhole treatment operation.

2. The pressure control valve according to claim 1, wherein the valve assembly includes a setting tube arranged in the valve body and operatively coupled to the piston, the setting tube including a first end, a second end, and an intermediate portion defining a conduit.

3. The pressure control valve according to claim 2, wherein the valve member includes a valve stem extending into the conduit of the setting tube.

4. The pressure control valve according to claim 3, wherein valve member includes a first flange arranged on the valve stem.

5. The pressure control valve according to claim 4, wherein the setting tube includes a second flange arranged at the first end.

6. The pressure control valve according to claim 5, further comprising: a cushioning spring arranged between the first flange and the second flange.

7. The pressure control valve according to claim 4, wherein the valve stem includes passage fluidically connected to the inlet.

8. The pressure control valve according to claim 7, wherein the valve member includes a fluid outlet portion fluidically connected to the passage.

9. The pressure control valve according to claim 1, further comprising: a control fluid source fluidically connected to the control fluid inlet of the piston assembly, the control fluid source introducing a pressurized control fluid into the piston assembly shifting the piston to bias the valve member in the closed configuration.

10. The pressure control valve according to claim 9, wherein the control fluid source comprises a fluid reservoir arranged in the valve body and fluidically connected to the control fluid inlet.

11. A resource exploration and recovery system comprising:

a surface system including a fluid storage zone; and a downhole system including a plurality of tubulars fluidically connected to the surface system, the downhole system also including a pressure control valve comprising:

a valve body including an inlet fluidically connected to the fluid storage zone, an outlet, and a valve seat;

a valve assembly arranged in the valve body, the valve assembly including a valve member selectively positionable on the valve seat to control fluid flow through the valve body; and a piston assembly including a piston and a control fluid inlet arranged in the valve body, the piston being operatively connected to the valve assembly, the piston being operable to bias the valve member from an open configuration toward a closed configuration upon exposure to control fluid pressure from the control fluid inlet to initiate a downhole treatment operation.

12. The resource exploration and recovery system according to claim 11, wherein the valve assembly includes a setting tube arranged in the valve body and operatively coupled to the piston, the setting tube including a first end, a second end, and an intermediate portion defining a conduit.

13. The resource exploration and recovery system according to claim 12, wherein the valve member includes a valve stem extending into the conduit of the setting tube.

14. The resource exploration and recovery system according to claim 13, wherein valve member includes a first flange arranged on the valve stem.

15. The resource exploration and recovery system according to claim 14, wherein the setting tube includes a second flange arranged at the first end.

16. The resource exploration and recovery system according to claim 15, further comprising: a cushioning spring arranged between the first flange and the second flange.

17. The resource exploration and recovery system according to claim 14, wherein the valve stem includes passage fluidically connected to the inlet, the passage including a fluid outlet portion.

18. The resource exploration and recovery system according to claim 11, further comprising: a control fluid source fluidically connected to the control fluid inlet of the piston assembly, the control fluid source introducing a pressurized control fluid into the piston assembly shifting the piston to bias the valve member in the closed configuration.

19. The resource exploration and recovery system according to claim 18, wherein the control fluid source comprises a fluid reservoir arranged in the valve body and fluidically connected to the control fluid inlet.

20. The resource exploration and recovery system according to claim 18, wherein the valve body includes a fluid supply line connector fluidically connected to the control fluid inlet, the control fluid source being arranged at the surface system and fluidically connected to the valve body through a fluid supply line fluidically connected to the fluid supply line connector.

* * * * *